US007561109B2

(12) United States Patent
Walton et al.

(10) Patent No.: US 7,561,109 B2
(45) Date of Patent: Jul. 14, 2009

(54) RECONFIGURABLE ANTENNA USING ADDRESSABLE PIXEL PISTONS

(75) Inventors: Eric K. Walton, Columbus, OH (US); Bruce G. Montgomery, Columbia, MD (US)

(73) Assignees: The Ohio State University Research Foundation, Columbus, OH (US); Syntonics LLC, Columbia, MD (US)

( * ) Notice: Subject to any disclaimer, the term of this patent is extended or adjusted under 35 U.S.C. 154(b) by 0 days.

(21) Appl. No.: 12/032,269

(22) Filed: Feb. 15, 2008

(65) Prior Publication Data

US 2008/0198074 A1 Aug. 21, 2008

Related U.S. Application Data

(60) Provisional application No. 60/890,224, filed on Feb. 16, 2007.

(51) Int. Cl.
*H01Q 1/38* (2006.01)

(52) U.S. Cl. ..... 343/700 MS; 343/909

(58) Field of Classification Search ..... 343/909, 343/700 MS

See application file for complete search history.

(56) References Cited

U.S. PATENT DOCUMENTS 7,046,198 B2 * 5/2006 Sakiyama et al. ..... 343/700 MS
7,250,909 B2 * 7/2007 Fujishima et al. ..... 343/700 MS
7,471,247 B2 * 12/2008 Saily et al. ..... 343/700 MS

* cited by examiner

*Primary Examiner*—James Cho
(74) *Attorney, Agent, or Firm*—Dinsmore & Shohl LLP

(57) ABSTRACT

An antenna made up of addressable conductive segments, or pixel elements, affixed to the top of each piston in a piston array is presented. The pixel elements can be activated in less than a millisecond to form an antenna array and transmission line pattern using movable pistons and a two-dimensional actuator. Each piston comprises a handle, a bottom conductive segment affixed to the top of the handle, a dielectric segment affixed to the uppermost surface of the bottom conductive segment, and a top conductive segment affixed to the uppermost surface of the dielectric segment. When the piston is not actuated, the top conductive segment forms part of a ground plane. The top conductive segment form part of the transmission line and antenna array patterns, the dielectric segment becomes a dielectric space and the bottom conductive segment forms part of the ground plane when the piston is actuated.

20 Claims, 2 Drawing Sheets

RECONFIGURABLE ANTENNA USING ADDRESSABLE PIXEL PISTONS

CROSS-REFERENCE TO RELATED APPLICATIONS

This application claims the benefit of U.S. Provisional Application Ser. No. 60/890,224 (OSU 0051 MA), filed Feb. 16, 2007. This Application is related to U.S. patent application Ser. No. 12/032,261 (OSU 0051a PA), filed Feb. 15, 2008 and Ser. No. 12/032,265 (OSU 0051b PA), filed Feb. 15, 2008.

GOVERNMENT LICENSE RIGHTS

The U.S. Government has a paid-up license in this invention and the right in limited circumstances to require the patent owner to license others on reasonable terms as provided for by the terms of contract No. W9113M-04-P-0061 awarded by U.S. Army Space and Missile Defense Command.

BACKGROUND OF THE INVENTION

The present invention relates to a reconfigurable antenna using addressable pixel elements.

In general, it is possible for an antenna to be made of conductive paths separated from a ground plane by a dielectric space. Such antennas can be built as a patch array with operational frequency, main beam direction and even main beam shape by printing a pattern of the transmission lines, power dividers and patch antennas on a surface above a dielectric.

However, in the past, the method of rapidly reconfiguring these types of antennas has been very restrictive. Typically, a set of radiating elements was connected to a transmission line with amplitude and phase shift elements embedded in the line. An alternative technique has been to use antenna modules with embedded phase and gain characteristics. Both of theses designs suffer from limitations due to the fixed geometry of the array of radiating elements and the configuration of the transmission lines.

Therefore, there is a need for an antenna that can be rapidly reconfigured to change its operational frequency band, its pointing angle, gain, bandwidth and its polarization in less than a millisecond. This patent describes a method for rapid reconfiguration through the use of small conductive segments, or pixel elements, to accomplish these changes.

BRIEF SUMMARY OF THE INVENTION

According to the present invention, an antenna array made up of a grid of small addressable conductive segments, or pixel elements, affixed to an array of movable shaped pistons is presented. The small pixel elements can be activated in less than a millisecond to form patterns that create an array of patch antennas and associated transmission lines. The antenna array and transmission line patterns can be formed using small shaped movable pistons. Each piston comprises a handle, a bottom conductive segment affixed to the top of the handle, a dielectric segment affixed to the uppermost surface of the bottom conductive segment, and a top conductive segment affixed to the uppermost surface of the dielectric segment. The pistons can be individually addressed to be on or off and controller by a two-dimensional actuator. When the pistons are in the on, or up, position, the top conductive segments form the transmission line and antenna array patterns, the dielectric segment becomes a dielectric space and the bottom conductive segment forms a ground plane. When the piston is in the off, or down, position, the top conductive segment becomes part of the ground plane.

In accordance with one embodiment of the present invention, the top conductive segments can be triangles, squares, hexagons, or any other suitable shape.

Accordingly, it is a feature of the embodiments of the present invention to be able to rapidly reconfigure the characteristics of an antenna in less than a millisecond. Other features of the embodiments of the present invention will be apparent in light of the description of the invention embodied herein.

BRIEF DESCRIPTION OF THE SEVERAL VIEWS OF THE DRAWINGS

The following detailed description of specific embodiments of the present invention can be best understood when read in conjunction with the following drawings, where like structure is indicated with like reference numerals and in which.

DETAILED DESCRIPTION

In the following detailed description of the embodiments, reference is made to the accompanying drawings that form a part hereof, and in which are shown by way of illustration, and not by way of limitation, specific embodiments in which the invention may be practiced. It is to be understood that other embodiments may be utilized and that logical, mechanical and electrical changes may be made without departing from the spirit and scope of the present invention.

According to the present invention, an antenna array can be built to be electronically configured and reconfigured in less than a millisecond. The transmission lines can be modified to steer the beam and the patch geometry can be modified to shift the operational frequency. The number, disposition, shape, size and feed point of the patches can be rapidly modified to change the array shape and gain as well as the polarization. In a swept-frequency radar embodiment, the resonant frequency of the antenna array can be tracked with the instantaneous frequency of the radar. Further, since the antenna can be half-duplex, the antenna can switch from the desired transmit characteristic to the desired receive characteristic as needed.

The transmission lines (e.g., striplines and microstrips) and antenna (e.g., patches or other radiating structures) can be formed, pixel by pixel, by moving an array of shaped pistons into conductive patterns. The conductive patterns can be formed using conductive particles, or pixel elements, individually attached to the uppermost surface of the array of pistons. The individual pistons in the array can be moved, or actuated, from a ground plane (i.e., the "off" state) to a predetermined distance over the ground plane (i.e., the "on" state) by a two-dimensional actuator. The ground plane can be any grounded surface, planar or non-planar. Each pixel element on the individual pistons can be individually addressed to be either "on" of "off" by the two-dimensional actuator.

Figure 1A:
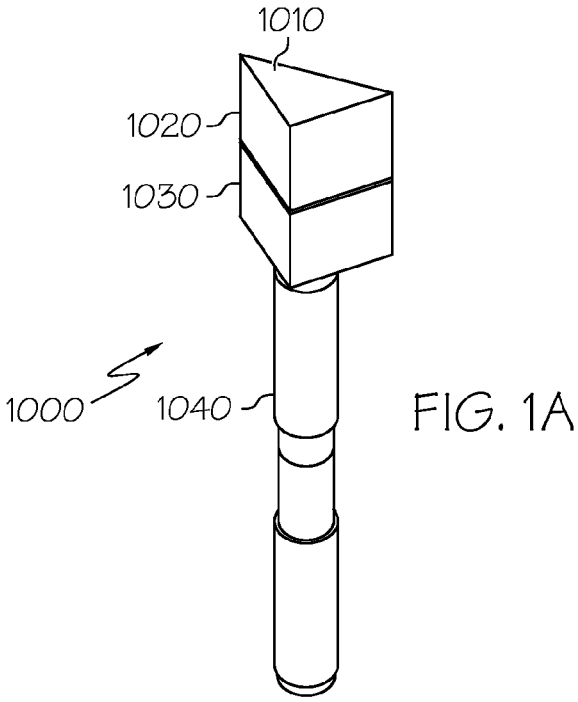
FIG. 1 illustrates a pixel-on-a-shaft concept used to create a four-element patch array antenna according to an embodiment of the present invention.
Figure 1B:
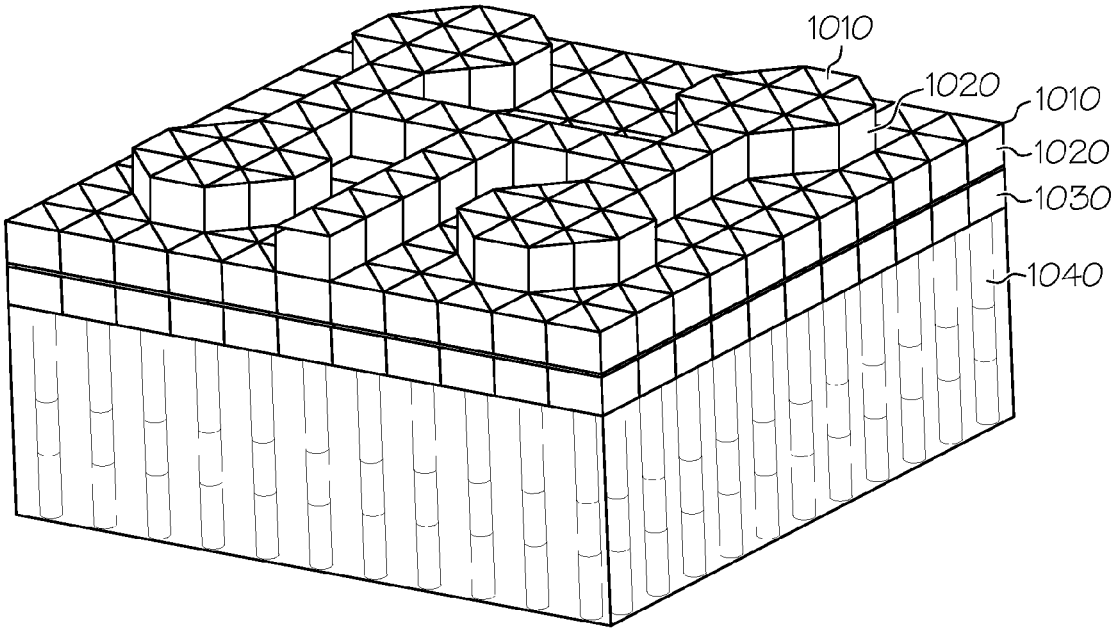

This embodiment, which may be referred to as a "pixel-on-a-shaft," is illustrated in FIG. 1. A small shaped piston 1000, or shaft, can be actuated to create the individual conductive antenna array elements. Each pixel element piston

1000 can have a shaft that extends below the antenna surface. The piston 1000 can comprise a top conductive segment 1010, a contained dielectric segment 1020, a bottom conductive segment 1030 and a long handle 1040. The top conductive segment 1010 can be the conductive pixel element and can have a width that is typically 1/20 wavelength, or about 0.7 mm at 21 GHz. The top conductive segment 10010 can comprise a metal such as, for example, copper or gold. The dielectric segment 1020 can have a length that can be typically 1/10 wavelength or about 1.4 mm at 21 GHz. The dielectric segment can be gas or a fluid dielectric. The bottom conductive segment 1030 can comprise a metal. The bottom conductive segment 1030 can comprise substantially the same metal as the top conductive segment 1020 but need not be the same metal. Finally, the piston 1000 can typically have an overall length of about 11 mm.

In this embodiment, when the piston 1000 is down, or in the "off" position, the top conductive segment 1010 becomes an extension of a ground plane. When the piston 1000 is actuated to move up, or in the "on" position, the top conductive segment 1010 can be one of the pixel elements that becomes part of the antenna array or transmission line, the dielectric segment 1020 forms part of the dielectric space, and the bottom conductive segment 1030 becomes an extension of the ground plane. The each individual piston in the array of pistons 1000 can be individually addressable and controllable by the two-dimensional actuator. Each piston 1000 can be controlled to move, or actuate, based on a actuator command. The piston 1000 can be actuated magnetically using a solenoid, capacitively, hydraulically using air or fluid pressure, mechanically, or by any other suitable method.

Although the present invention has been described as moving the array of pixel element pistons up and down, it should be understood that the antenna arrays and transmission lines themselves can be in any suitable orientation. It is possible to position the antenna array and the transmission lines on their sides as well as upside down. The term "up" refers to moving the pixel element piston from the ground plane to a predetermined distance over the ground plane. Likewise, the term "down" refers to the pixel element piston moving from the predetermined distance towards the ground plane. Additionally, for the purposes of describing and defining the present invention, formation of a material "on" a layer refers to formation in contact with a surface of the layer. Formation "over" a layer refers to formation above or in contact with a surface of the layer.

Figure 2:
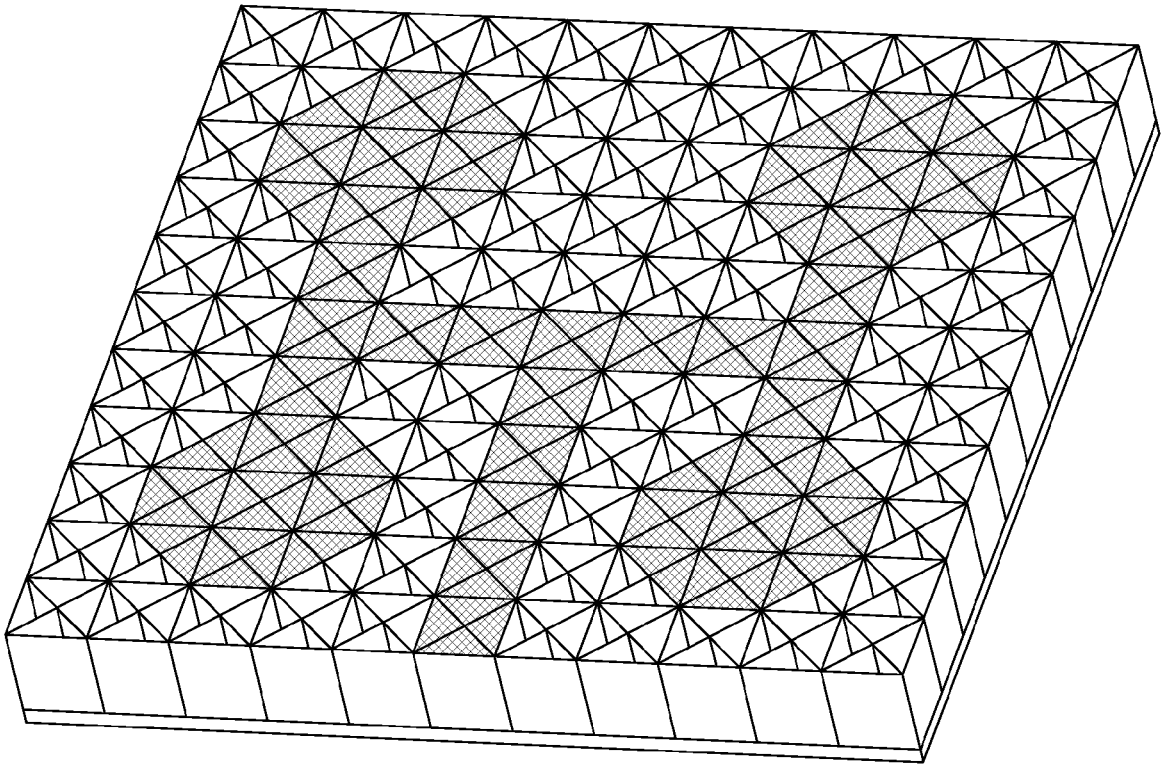
FIG. 2 illustrates a triangular shaped top conductive segment according to an embodiment of the present invention.

The geometry of the top conductive segment can be nearly any shape. The shape of the top conductive segment helps determine the nature shape of the bends and interconnects that can be created by the antenna array patterns. For example, in one embodiment, the top conductive segment can be a 45-45-90 degree triangle. This shape can allow for 45 degree and 90 degrees turns more easily. In another embodiment, the top conductive segment can be square. This shape can allow for 90 degree turns and can make interconnects simple and effective. In yet another embodiment, the top conductive segment may be a hexagon. This shape can allow for 30 and 60 degree turns to be more effective and efficient. In still another embodiment, the top conductive segment can be a shape that "tiles the plane" of the antenna array. This top conductive segment shape can be optimized for improved geometrical flexibility and pixel-to-pixel capacitance. Additionally, the individuals top conductive segments can be a variety of different shapes, depending on whether the top conductive segments are to form an antenna element, a transmission line, a power splitter, or any other suitable application known in the art. Referring to FIG. 2, an example is illustrated of the individual top conductive segments of the pistons can be triangular shape that can be moved up from the ground plane or down towards the ground plane.

However, the size of the wavelength of the electromagnetic signal used by the antenna array can be a design constraint and should be taken into consideration. For example, the pixel element cannot be too large or the resulting transmission line can be potentially multimode and the structural control can be too limited. On the other hand, if the pixel element is too small, it can be difficult to control. Therefore, pixel element sizes of about 1/10 of a wavelength have been shown to be effective.

The antenna characteristics can be easily and quickly modified using this invention. For example, the direction of the antenna array beam can be determined by the phase distribution on the antenna array. Alternatively, the direction of the antenna beam can be determined by the differential phase or time delay along the transmission line. The location of the feed point can be shifted to shift the differential phase or time and, therefore, the main beam direction. The beamwidth can be determined by the size of the array and by the distribution of amplitude over the array. The beamwidth can be controlled using the pixel-based transmission lines. Polarization can be determined by how the antenna pixel elements are fed and by the geometry of the antenna pixel elements.

The frequency of operation of the antenna can be determined by the feed point and the size of the antenna. The size of the pixel-generated antennas, the number of array elements, and the power distribution over the array can be dynamically adjusted to yield the desired operational frequency.

Further, multiple antennas may use a single aperture. There is no electromagnetic limit to the number of feed points in the array aperture. It possible to have several feed points as well as several types of feeds (e.g., edge and thru-ground). Because of this, multiple radio/radar systems can use the same aperture.

Power distribution can be achieved by using directional couplers. Directional couples can be created by programming the geometry of the feed lines as is known in the art. Alternatively, power distribution can be achieved by using multiple transmission line impedance. The impedance of a transmission line can be controlled by the changing the width of the transmission line. For example, two transmission lines can be connected together so that a good impedance match can be achieved. Pixel element transmission lines can be created with various widths and thus various impedances. A single transmission line (i.e., the input) can be connected to two other transmission lines (i.e., the output) to form an effective feed system for a desired array antenna.

Additionally, stub tuning concepts can be used to further optimize the performance of the antenna array. Small stubs can be attached to the transmission lines as known in the art to tune components of the antenna arrays and to improve the feed point impedance match.

To feed the antenna from the edge, a coaxial to edge launch can be used to connect the antenna to the edge. Edge launch techniques and/or techniques that are known in the art can be used to excite the transmission edge. To feed the antennas from below the ground plane (i.e., away from the edge), techniques known in the art to feed transmission lines from below the ground plane can be used.

In summary, patterns can be generated on the face of specialized panels to create antenna arrays and transmission lines. The antennas can be operated at nearly any frequency and with antenna characteristics (e.g., gain, beam direction, beam width, polarization, etc.) that can be changed in less than a millisecond. Such an antenna can be used on space vehicles, aircraft and ground vehicles. In addition, such an antenna can be useful for any application where space and weight are limited and the need for communication, navigation and sensing are high. The programmability of the antenna characteristics means that such a panel antenna can be usable for many applications.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplaned that the present invention is not necessarily limited to these preferred aspects of the invention.

What is claimed is:

1. An antenna structure, comprising:

a two-dimensional actuator;

an array of pistons positioned over the actuator, each piston in the array comprising, a handle, a bottom conductive segment affixed to the top of the handle, a dielectric segment affixed to the uppermost surface of the bottom conductive segment, and a top conductive segment affixed to the uppermost surface of the dielectric segment, wherein the top conductive segment forms part a ground plane when the piston is not actuated, wherein when a subset of the pistons is actuated by the two-dimensional actuator, the top conductive segments of a subset of the array of pistons form transmission line and antenna array patterns and the bottom conductive segments of the subset of the array of pistons integrates with the ground plane.

2. The antenna structure of claim 1, wherein the two-dimensional actuator controls the positioning of each piston in the array of pistons.

3. The antenna structure of claim 2, wherein the two-dimensional actuator is configured to control the positioning of the pistons magnetically, capacitively, hydraulically, mechanically, or combinations thereof.

4. The antenna structure of claim 1, wherein the shape of the top conductive segment comprises triangles, squares, hexagons, or any other suitable shape.

5. The antenna structure of claim 1, wherein the top conductive segment is comprised of metal.

6. The antenna structure of claim 5, wherein the metal of the top conductive segment comprises gold, copper or combinations thereof.

7. The antenna structure of claim 1, wherein the top conductive segment has width of approximately 1/20 wavelength.

8. The antenna structure of claim 1, wherein top conductive segment has a width of about 0.7 mm at 21 GHz.

9. The antenna structure of claim 1, wherein the dielectric segment has a length of about 1/10 wavelength.

10. The antenna structure of claim 1, wherein the dielectric segment of about 1.4 mm at 21 GHz.

11. The antenna structure of claim 1, wherein the bottom conductive segment is comprised of substantially the same metal as the top conductive segment.

12. The antenna structure of claim 1, wherein the piston has an overall length of about 11 mm.

13. A method of rapidly configuring antenna structure, the antenna structure comprises a two-dimensional actuator, an array of pistons, each piston comprising a top conductive segment, a dielectric segment, a bottom conductive segment and a handle, wherein the method comprises:

forming a ground plane with the top conductive segments of the array of pistons when the array of pistons is not actuated by the two-dimensional actuator;

creating antenna arrays and transmission lines by forming conductive patterns with the top conductive segments over the ground plane by actuating the individual pistons of the array of pistons to move from the ground plane to a predetermined distance over the ground plane using the two-dimensional actuator, such that the bottom conductive segment integrates with the ground plane when the piston is actuated.

14. The method of claim 13, further comprises:

positioning of the array of pistons magnetically, capacitively, hydraulically, mechanically, or combinations thereof.

15. The method of claim 13, further comprises:

reconfiguring the patterns of the antenna arrays and the transmission lines in less than a millisecond.

16. The method of claim 13, further comprises:

controlling beamwidth by using the formed transmission lines and antenna arrays.

17. The method of claim 13, further comprises:

determining polarization by the geometry of the pixel elements and how the pixel elements are fed.

18. The method of claim 13, further comprises:

adjusting the size of the antenna array, the number of elements in the antenna array and power distribution over the antenna array to yield a desired operational frequency and gain pattern.

19. The method of claim 13, further comprising:

attaching small stubs to the transmission lines to optimize the performance of the antenna array.

20. The method of rapidly reconfiguring an antenna structure, the method comprising:

providing an array of pistons, each piston comprising, a handle, a bottom conductive segment affixed to the top of the handle, a dielectric segment affixed to the uppermost surface of the bottom conductive segment, and a top conductive segment affixed to the uppermost surface of the dielectric segment, wherein the top conductive segment integrate to form a ground plane when not actuated;

forming transmission lines and antenna array patterns by moving a subset of the array of pistons up from the ground plane until the bottom conductive segment becomes integrated with the ground plane; and controlling the formation of the transmission lines and antenna array patterns by a two-dimensional actuator.

* * * * *

UNITED STATES PATENT AND TRADEMARK OFFICE

CERTIFICATE OF CORRECTION

PATENT NO. : 7,561,109 B2
APPLICATION NO. : 12/032269
DATED : July 14, 2009
INVENTOR(S) : Eric K. Walton et al.

It is certified that error appears in the above-identified patent and that said Letters Patent is hereby corrected as shown below:

Column 1, line 16, cancel the text beginning with "The U.S. Government" to and ending "mand." in Column 1, line 21, and insert the following:

--This invention was made with government support under Contract No. W9113M-04-P-0061 awarded by U.S. Army Space and Missile Defense Command. The government has certain rights in the invention.--

Signed and Sealed this
Eighteenth Day of October, 2011

David J. Kappos

David J. Kappos
*Director of the United States Patent and Trademark Office*